US007515131B2

(12) United States Patent
Takeda

(10) Patent No.: US 7,515,131 B2
(45) Date of Patent: Apr. 7, 2009

(54) LIQUID CRYSTAL DISPLAY DEVICE AND DRIVING METHOD THEREOF

(75) Inventor: Hiroshi Takeda, Kanagawa (JP)

(73) Assignee: NEC LCD Technologies, Ltd., Kawasaki, Kanagawa (JP)

( * ) Notice: Subject to any disclaimer, the term of this patent is extended or adjusted under 35 U.S.C. 154(b) by 107 days.

(21) Appl. No.: 11/281,619

(22) Filed: Nov. 18, 2005

(65) Prior Publication Data

US 2006/0125772 A1 Jun. 15, 2006

(30) Foreign Application Priority Data

Nov. 25, 2004 (JP) ..... 2004-340698

(51) Int. Cl.
*G09G 3/36* (2006.01)

(52) U.S. Cl. ..... 345/87; 345/77; 345/204

(58) Field of Classification Search ..... 315/169.3, 315/291, 307, 312, 360; 345/102, 204, 211, 345/76–77, 87, 90
See application file for complete search history.

(56) References Cited

U.S. PATENT DOCUMENTS

| | | | | |
|---|---|---|---|---|
| 5,428,366 | A * | 6/1995 | Eichenlaub | 345/102 |
| 6,661,181 | B2 * | 12/2003 | Shin | 315/169.4 |
| 2002/0113761 | A1 * | 8/2002 | Mizutani et al. | 345/87 |
| 2004/0114396 | A1 * | 6/2004 | Kobayashi et al. | 362/561 |
| 2004/0183960 | A1 * | 9/2004 | Kim et al. | 349/61 |
| 2004/0246412 | A1 * | 12/2004 | Kim et al. | 349/113 |
| 2005/0117190 | A1 * | 6/2005 | Iwauchi et al. | 359/237 |
| 2005/0162360 | A1 * | 7/2005 | Ishihara et al. | 345/89 |
| 2005/0200614 | A1 * | 9/2005 | Masubuchi et al. | 345/204 |
| 2006/0158446 | A1 * | 7/2006 | Gong et al. | 345/211 |
| 2006/0192747 | A1 * | 8/2006 | Yoon et al. | 345/102 |

FOREIGN PATENT DOCUMENTS

| | | |
|---|---|---|
| CN | 1470045 A | 1/2004 |
| CN | 1532596 A | 9/2004 |
| JP | 2001-312228 | 11/2001 |
| JP | 2003-35893 | 2/2003 |
| KR | 2003-0074340 | 9/2003 |
| KR | 10-2004-0083121 | 10/2004 |
| KR | 10-2004-0098492 | 11/2004 |

OTHER PUBLICATIONS

Korean Office Action dated Dec. 15, 2006, with partial English translation.
Chinese Office Action dated Jul. 27, 2007 (with English translation).

* cited by examiner

*Primary Examiner*—David Hung Vu
*Assistant Examiner*—Tung X Le
(74) *Attorney, Agent, or Firm*—McGinn IP Law Group, PLLC

(57) ABSTRACT

It is a liquid crystal display device which can display simultaneously information which is different in the front and rear sides. It has a single liquid crystal panel, a lighting unit which is arranged at both-sides and comprised with the light source, and a control circuit which carries out drive controlling of these. This control circuit controls lighting on and off the light source of the lighting unit and controls a screen display of the liquid crystal panel, and realize the display which is different to both sides of the liquid crystal panel. Thereby, when the screen of the liquid crystal panel is simultaneously seen from both sides, an independent different image can be recognized visually.

19 Claims, 6 Drawing Sheets

LIQUID CRYSTAL DISPLAY DEVICE AND DRIVING METHOD THEREOF

BACKGROUND OF THE INVENTION

1. Field of the Invention

The present invention relates to a liquid crystal display device and driving method thereof, and more particularly to a liquid crystal display device which enables double-sided indication, and the driving method thereof.

2. Description of the Related Art

The liquid crystal display device is a display device having advantageous features, such as low power consumption, thin shape and light weight. Their utilization scenes are more and more increased. The manufacturing technology is established with required screen sizes, large-sized electronic equipment such as a large-screen TV, medium-sized electronic equipment such as a notebook personal computer and a display monitor, and small-sized electronic equipment such as a portable telephone and PDA, and it is put in practical use in various screen sizes.

Generally the liquid crystal display device includes: a liquid crystal panel, a drive control circuit for controlling the display image of the liquid crystal panel, a terminal part that consists of operation keys for adjusting the displaying condition of the liquid crystal panel, and the power supplying part which supplies operation power to these element. With the liquid crystal display device, the single-sided indication as which a user regards the image displayed on the liquid crystal panel of one sheet from one side has so far been used mainly. However, in order to increase the amount of displayed information, the double-sided indication device is proposed by arranging two liquid crystal panels back to back.

Moreover, a further advanced double-sided indication device is proposed by using a single liquid crystal panel. For example, the single liquid crystal panel has an upper area and a lower area so as to be considered as a front-side display area and a rear-side display area, respectively. Such a double-sided display is proposed by Japanese Laid-Open Patent No. 2001-312228, wherein a liquid crystal panel is incorporated into a foldaway cellular phone. The upper area is used as an inner side indication area, and the lower area is used as an outside indication area. When an user opens or unfolds the cellular phone, the user can see the indication on the inner side indication area. When the user closes or folds the cellular phone, the user can see the indication on the outside indication area.

In Japanese Laid-Open Patent No. 2003-35893, another double-sided indication device with a single liquid crystal panel is proposed. Here, light guide plates, back light units, and dimming glasses are arranged in front of and rear of single liquid crystal panel, respectively. These are incorporated in a lid of a foldable portable information device. When the lid is lifted, a back light located outside of the lid is turned on, and a rear dimming glass located outside of the lid is made into an opaque state, and a front dimming glass located inside the lid is made into a transparent state. Thereby, a user can seethe indication on the inner side indication area. When the lid is folded, a back light located inside the lid is turned on, the front dimming glass is made into an opaque state, and the rear dimming glass located is made into a transparent state. Thereby, a user can see the indication on the outside indication area.

However, in the liquid crystal display device proposed by the above-stated Japanese Laid-Open Patent No. 2001-312228, since the double-sided indication is realized by dividing a liquid crystal panel into two areas, the whole display area is the same as the case of a single-sided display.

Thus, the problem occurs that the spatial relationship of an inner side indication area and an outside indication area is fixed, and the flexibility which arranges a display area becomes small.

In the above-stated Japanese Laid-Open Patent No. 2003-35893, on the other hand, since the double-sided display is realized by arranging a light guide plate and the back light at front and rear sides of a liquid crystal panel, respectively, the foregoing problem does not occur. However, it cannot simultaneously display on the both sides of a liquid crystal panel.

SUMMARY OF THE INVENTION

The present invention provides a liquid crystal display device which can display different information substantially on the front and rear sides of a single liquid crystal panel, and the driving method thereof.

According to a liquid crystal display device of the present invention, includes: a liquid crystal panel performing picture display according to input visual data, a first lighting unit having a first light guide plate and a first light source supplying a light with the first light guide plate, and located in front side of the liquid crystal panel, a second lighting unit having a second light guide plate and a second light source supplying a light with the second light guide plate, and located in the rear side of the liquid crystal panel, and a control unit for turning on the second light source of the second lighting unit and radiating the liquid crystal panel, and supplying a first picture data to the liquid crystal panel, during a first display period, and turning on the first light source of the first lighting unit and radiating the liquid crystal panel, and supplying a second picture data to the liquid crystal panel, during a second display period different from the first display period.

Preferably, the first lighting unit and the second lighting unit are flat-shaped lighting units, respectively.

Preferably, the liquid crystal panel is transmissive type, and wherein picture display is performed by a light transmitted through the liquid crystal panel, which is radiated from the first lighting unit or the second lighting unit.

Preferably, one frame period includes the first display period and the second display period.

Preferably, the first lighting unit and the second lighting unit are controlled to turn on or off the light by a time-divisional mode, respectively.

Preferably, the liquid crystal display device further including: a third lighting unit having a third light guide plate and a third light source supplying a light with the third light guide plate, and located in front side of the liquid crystal panel, and a fourth lighting unit having a fourth light guide plate and a fourth light source supplying a light with the fourth light guide plate, and located in the rear side of the liquid crystal panel, wherein the control unit turn on the third light source of the third lighting unit and radiating the liquid crystal panel, and supplying a third picture data to the liquid crystal panel, during the first display period, and wherein the control unit turn on the fourth light source of the fourth lighting unit and radiating the liquid crystal panel, and supplying a fourth picture data to the liquid crystal panel, during the second display period.

Preferably, said first lighting unit through said fourth lighting unit are flat-shaped lighting units, respectively.

Preferably, picture display is performed by a light transmitted through the liquid crystal panel, which is radiated from the third lighting unit or the fourth lighting unit.

Preferably, the third lighting unit and the fourth lighting unit are controlled to turn on or off the light by a time-divisional mode, respectively.

According to the driving method of the liquid crystal display device of the present invention, the liquid crystal display device including: a liquid crystal panel performing a picture display according to input visual data; a first lighting unit having a first light guide plate and a first light source supplying a light with the first light guide plate, and located in front side of the liquid crystal panel; and a second lighting unit having a second light guide plate and a second light source supplying a light with the second light guide plate, and located in the rear side of the liquid crystal panel, the driving method includes the steps of: turning on the second light source of the second lighting unit and radiating the liquid crystal panel, and supplying a first picture data to the liquid crystal panel, during a first display period, and turning on the first light source of the first lighting unit and radiating the liquid crystal panel, and supplying a second picture data to the liquid crystal panel, during a second display period different from the first display period.

Preferably, the first lighting unit and the second lighting unit are flat-shaped lighting units, respectively.

Preferably, the liquid crystal panel is transmissive type, and wherein picture display is performed by a light transmitted through the liquid crystal panel, which is radiated from the first lighting unit or the second lighting unit.

Preferably, one frame period comprises the first display period and the second display period.

Preferably, the first lighting unit and the second lighting unit are controlled to turn on or off the light by a time-divisional mode, respectively.

Preferably, the driving method of the liquid crystal display device, the liquid crystal display device further including: a third lighting unit having a third light guide plate and a third light source supplying a light with the third light guide plate, and located in front side of the liquid crystal panel; and a fourth lighting unit having a fourth light guide plate and a fourth light source supplying a light with the fourth light guide plate, and located in the rear side of the liquid crystal panel, the driving method further including the steps of: turning on the third light source of the third lighting unit and radiating the liquid crystal panel, and supplying a third picture data to the liquid crystal panel, during the first display period, and turning on the fourth light source of the fourth lighting unit and radiating the liquid crystal panel, and supplying a fourth picture data to the liquid crystal panel, during the second display period.

Preferably, said first lighting unit through said fourth lighting unit are flat-shaped lighting units, respectively.

Preferably, picture display is performed by a light transmitted through the liquid crystal panel, which is radiated from the third lighting unit or the fourth lighting unit.

Preferably, the third lighting unit and the fourth lighting unit are controlled to turn on or off the light by a time-divisional mode, respectively.

Preferably, the first display period is an even frame period, and wherein the second display period is an odd frame period.

According to the liquid crystal display device and its driving method of a present invention, during the first display period, the second light source of the second lighting unit is turned on, and the above-mentioned liquid crystal panel is made to irradiate by the light from the second light source, and the first image data is supplied to the above-mentioned liquid crystal panel. During the second display period different from the first display period, the first light source of the first lighting unit is turned on, and the above-mentioned liquid crystal panel is made to irradiate by the light from the first light source, and the second image data is supplied to the above-mentioned liquid crystal panel. Thereby, during the first display period, an indication based on the first image data is performed by the front side of the liquid crystal panel, and during the second display period, an indication based on the second image data is performed by the rear side of the liquid crystal panel. As a result, a double-sided display can be realized almost simultaneous by the front and the rear side of the liquid crystal panel.

Moreover, in the liquid crystal display device and the driving method of the present invention, contents which are different by the front and the rear side of the liquid crystal panel can be displayed, and useful information service can be obtained.

BRIEF DESCRIPTION OF THE DRAWINGS

These and other objects and advantages and further description of the invention will be more apparent to those skilled in the art by reference to the description, taken in connection with the accompanying drawing, in which.

DETAILED DESCRIPTION OF THE PREFERRED EMBODIMENTS

Hereinafter, desirable embodiments of the invention will be described with reference to the drawings.

The present invention is characterized by providing the liquid crystal display device and the driving method, which enables the different indication, using a single liquid crystal panel, when the liquid crystal panel is simultaneously seen from both sides.

Figure 2:
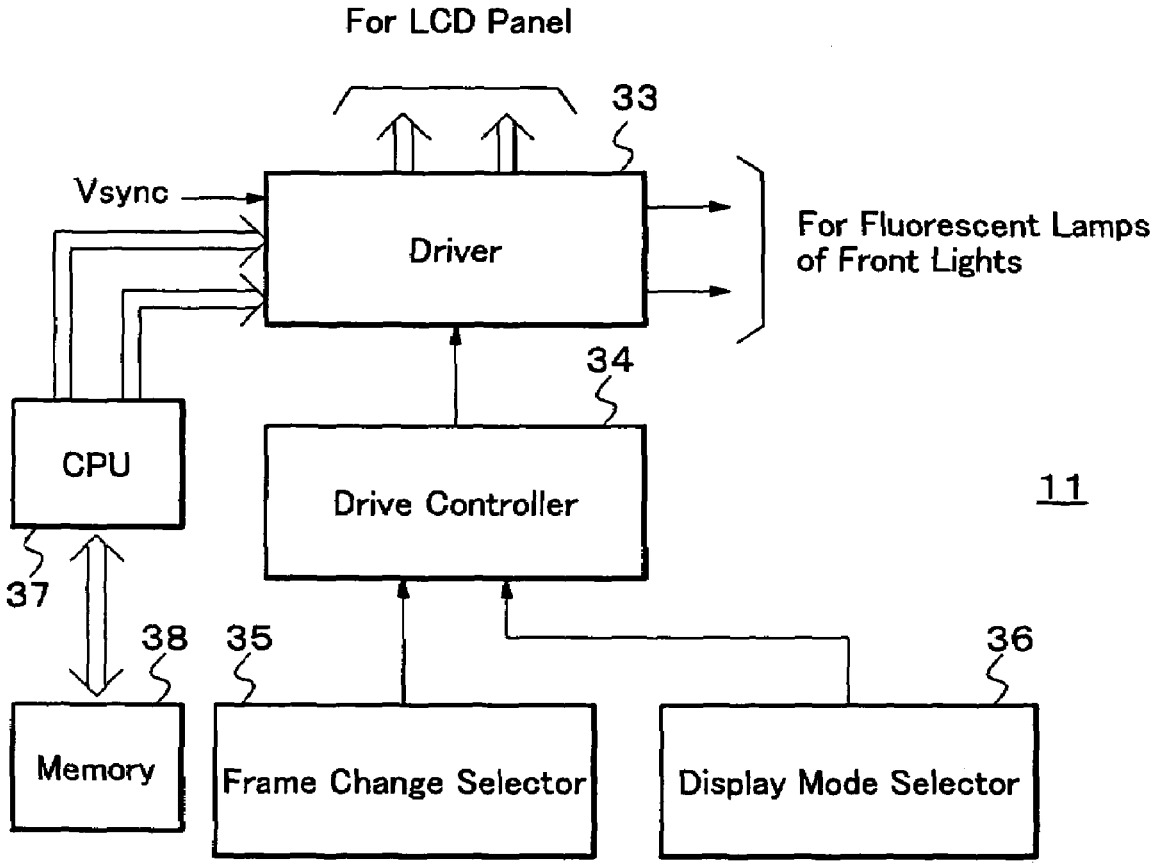
FIG. 2 is a main block diagram for explaining a control circuit 11 which performs frame switching of the liquid crystal display device shown in FIG. 1.

First, liquid crystal display device according to the present invention is characterized by including a liquid crystal panel, a pair or two pairs of flat-shaped lighting units each having a light guide plate and a light source and arranged at both sides of the liquid crystal panel, and a control circuit, as shown in FIG. 2, which performs control by turning a pair or two pairs of lighting units for illuminating a front side or rear side of the liquid crystal panel; and displaying different picture at both the front side and rear side of the liquid crystal display device. It is characterized by displaying an image which is different in the front side and rear side of the liquid crystal panel.

The driving method of the liquid crystal display device of a present invention is characterized by the steps of: controlling the liquid crystal panel and the light source of the lighting unit serving as a illuminating means based on the setup information for switching in a predetermined period for driving the front side or rear side of the liquid crystal panel, and displaying a different image which became independent to the front and the rear sides of the liquid crystal panel.

The First Embodiment

Figure 1:
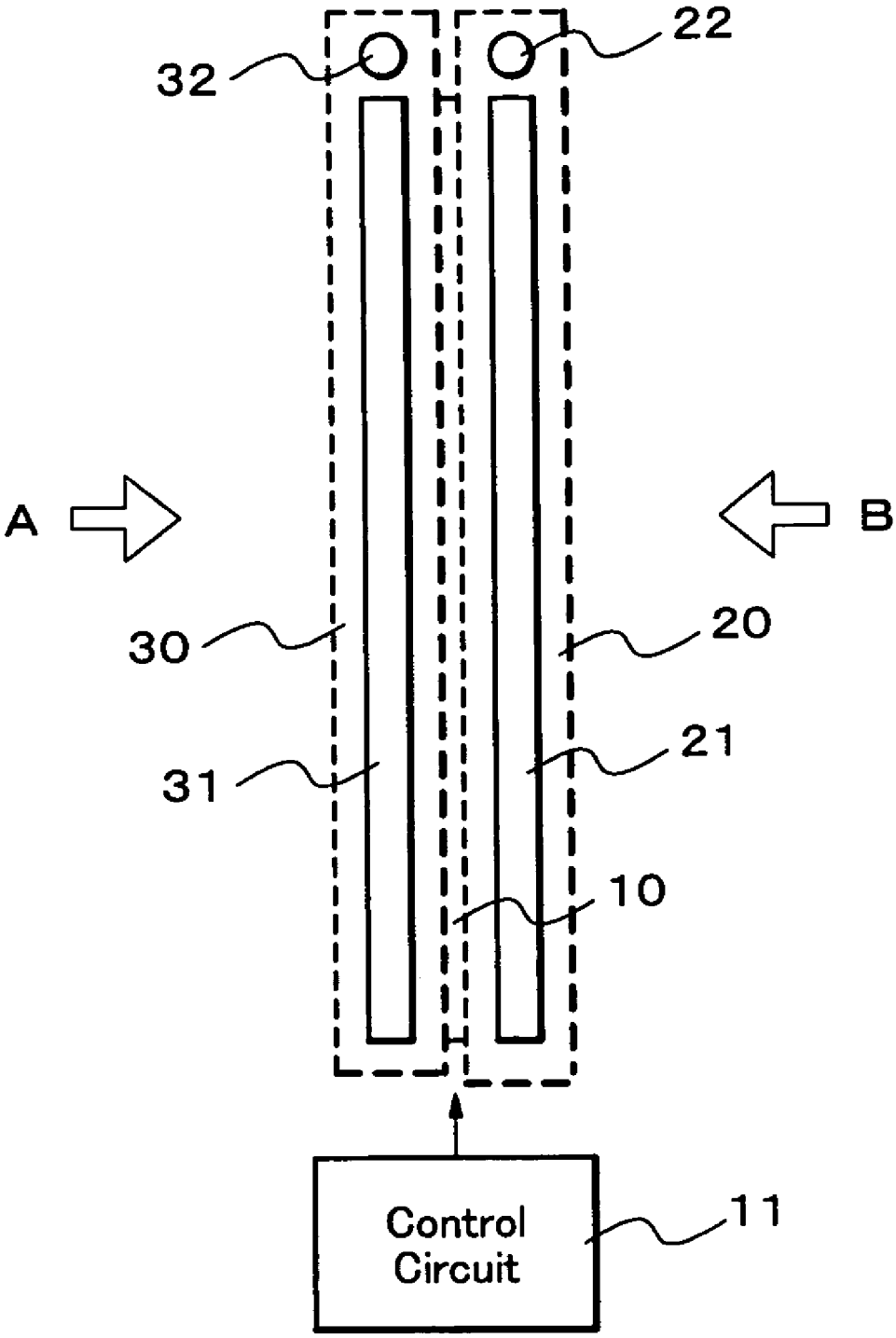
FIG. 1 is a block diagram for explaining a liquid crystal display device according to a first exemplary embodiment of the invention.
Figure 3:
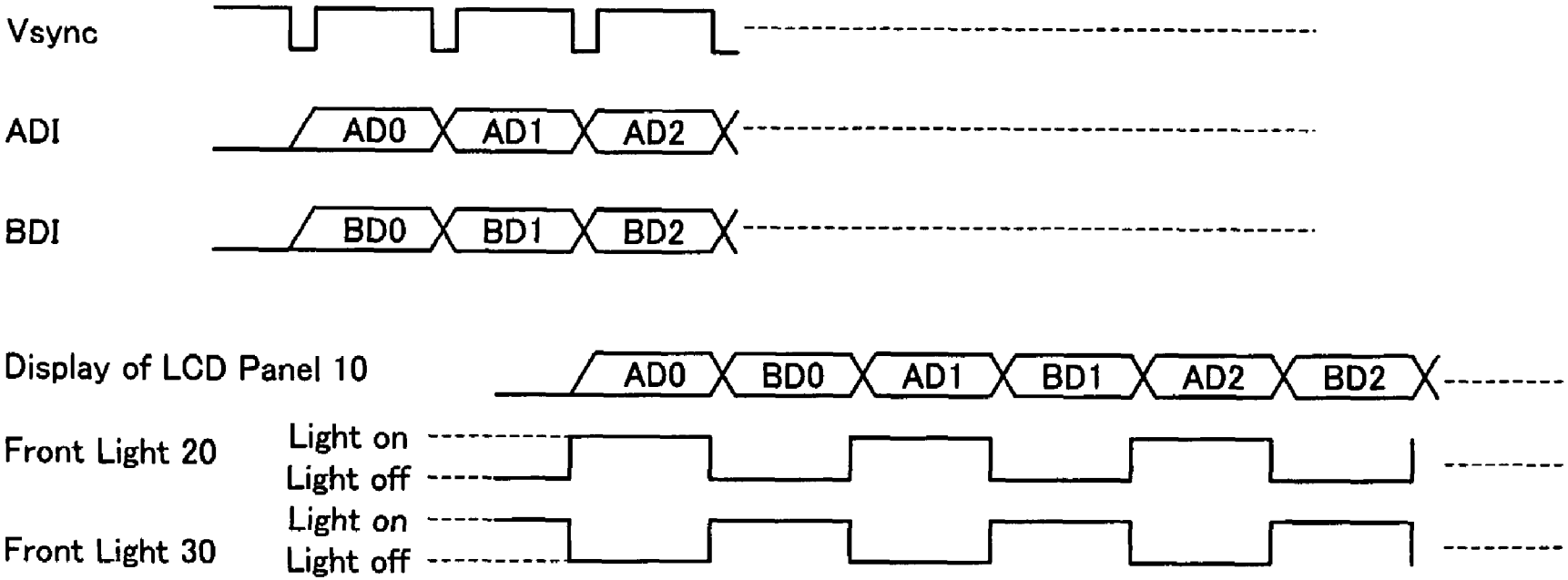
FIG. 3 is a wave form chart for explaining the operation timing of the driving control signal in FIG. 1.

Referring to FIGS. 1 to 3, the liquid crystal display device and the driving method of the first exemplary embodiment of a present invention are explained.

As shown in FIG. 1, the liquid crystal display device according to the embodiment, includes a single liquid crystal panel 10, lighting units 20 and 30 as an example of illuminating means located both sides of the liquid crystal panel 10, and a control circuit 11 for driving control of the liquid crystal panel 10. Here, the liquid crystal panel 10 is a transmission type. In a liquid crystal panel of transmission type, display is achieved by transmitting irradiation light through the liquid crystal panel. Each of lighting units 20 and 30 includes light guide plates 21 and 31 for irradiating the liquid crystal panel 10, and fluorescent lamps 22 and 32 are used as an example of the light source, respectively. The control circuit 11 inputs the image data signal for the directions of observation point A, and the image data signal for the directions of observation point B into liquid crystal panel 10 alternately. When the liquid crystal panel 10 shows the image data signal for the directions of observation point A, the lighting unit 30 is turned off, and the lighting unit 20 is turned on by the control circuit 11. When the liquid crystal panel 10 shows the image data signal for the directions of observation point B, the lighting unit 20 is turned off, and the lighting unit 30 is turned on by the control circuit 11. By repeating such a display action alternately, contents which are different when it sees from observation point A and B both directions can be displayed simultaneously.

That is, the lighting unit 20 is an illuminating unit for the indication for the directions of observation point A, and as mentioned above, it comprises the light guide plate 21 and the fluorescent lamp 22. Similarly, the lighting unit 30 is an illuminating unit for the indication for the directions of observation point B, and as mentioned above, it comprises the light guide plate 31 and the fluorescent lamp 32. Therefore, the liquid crystal panel 10 can perform frame switching action based on the predetermined time set up in the control circuit 11, and can display a different image (it became independent) alternately. In the embodiment, each lighting unit 20 and 30 function as a back light to liquid crystal panel 10.

Next, the organization of the control circuit 11 is explained, referring to FIG. 2. This control circuit 11 includes a driver 33 which supplies a drive voltage to the liquid crystal panel 10 and the fluorescent lamps 22 and 32 of each lighting unit, a frame change selector 35, a display mode selector 36, and a drive controller 34. A CPU 37 for creating image data and a memory 38 are built in the control circuit 11. The driver 33 creates the drive voltage to the liquid crystal panel 10 based on a vertical synchronizing signal Vsync, the image data from the CPU 37 and setup information from the drive controller 34, and it controls lighting on or off of the fluorescent lamps 22 and 32 of the lighting units 20 and 30. The frame change selector 35 sets up the screen (frame) display time and the switching time over both sides of the liquid crystal panel 10. The display mode selector 36 sets up the display mode of the liquid crystal panel 10. The drive controller 34 sends out setup information to the driver 33 using the information set up by each of these selectors 35 and 36.

As a result, based on setup information, the driver 33 drives to realize the different indication, namely, independent indication at both sides, that is front side and rear side of the liquid crystal panel 10 alternately. Therefore, when this liquid crystal display device is incorporated into a cellular phone, the user can recognize as an image (it became independent) which is different in the front side and the rear side of the liquid crystal panel 10 is displayed, when it sees from the front and rear side simultaneously.

At the embodiment, the front indication and the rear indication of the liquid crystal panel are switched with the frame period. Next, a control of an image data signal and the control timing of a lighting unit are explained. First, the driver 33 in the control circuit 11 takes in the vertical synchronizing signal Vsync, and image data ADI and BDI. This image data ADI is an image data signal for giving the indication for observation point A of the liquid crystal panel 10. Image data AD0 denotes image data of first frame, image data AD1 denotes image data of second frame, and image data AD2 denotes image data of third frame. On the other hand, BDI is an image data signal for giving the indication for observation point B of the liquid crystal panel 10. Image data BD0 denotes image data of first frame, image data BD1 denotes image data of second frame, and image data BD2 denotes image data of third frame. Therefore, the driver 33 of the control circuit 11 controls the liquid crystal panel 10 so that the image data ADI for the observation point A and the image data BDI for the observation point-Bare displayed alternately.

Specifically, when displaying the image data ADI for the observation point A on the liquid crystal panel 10, the control circuit 11 makes the fluorescent lamp 22 of the lighting unit 20 turn on, and makes the fluorescent lamp 32 of the lighting unit 30 turn off. When displaying the image data BDI for the observation point B on the liquid crystal panel 10, the control circuit 11 makes the fluorescent lamp 32 of the lighting unit 30 turn on, and makes the fluorescent lamp 22 of the lighting unit 20 turn off.

By such control, when the liquid crystal panel 10 is seen from the observation point A, the fluorescent lamp 22 of the lighting unit 20 is turned on, and the fluorescent lamp 32 of the lighting unit 30 is turned off. At this time, the light guide plate 21 of the lighting unit 20 emits light in response to the light from lit fluorescent lamp 22. The emitted light from the lighting unit 20 is transmitted through the liquid crystal panel 10, and the user at the point A can recognize visually the indication based on the image data ADI for the observation point A supplied to the liquid crystal panel 10.

Since the transmitted light of the direction of observation point A becomes small far compared with the time of the lighting unit 20 being on when the lighting unit 20 is turned off and the lighting unit 30 is turned on, it is mostly recognized as a black indication. Since the time of one frame becomes 1/60 seconds when for example, operating frequency is 60 Hz. From observation point A, the display screen on the side of the direction of observation point B is displayed blackly. However, it is not recognized by one's eyes when it switches in 1/60 seconds.

When the liquid crystal panel 10 is seen from the observation point B, the fluorescent lamp 32 of the lighting unit 30 is turned on, and the fluorescent lamp 22 of the lighting unit 20 is turned off. At this time, the light guide plate 31 of the lighting unit 30 emits light in response to the light from lit fluorescent lamp 32. The emitted light of this lighting unit 30 is transmitted through the liquid crystal panel 10, and the user at the point B can recognize visually the indication based on the image data BDI for the observation point B supplied to the liquid crystal panel 10. Since the transmitted light of the direction of observation point B becomes small far compared with the time of the lighting unit 30 being on when the lighting unit 30 is turned off and the lighting unit 20 is turned on, it is mostly recognized as a black indication.

Even when according to the embodiment the front indication and the rear indication of the liquid crystal panel are switched in every one frame period, and it sees simultaneously from the both sides of the panel, different images can be displayed on both sides of the panel, and thus the amount of display information can be increased. Since the double-sided display is realized without dividing the display area of a liquid crystal panel, the area of a display area can be doubled compared with the case of a single-sided display.

The Second Embodiment

Figure 4:
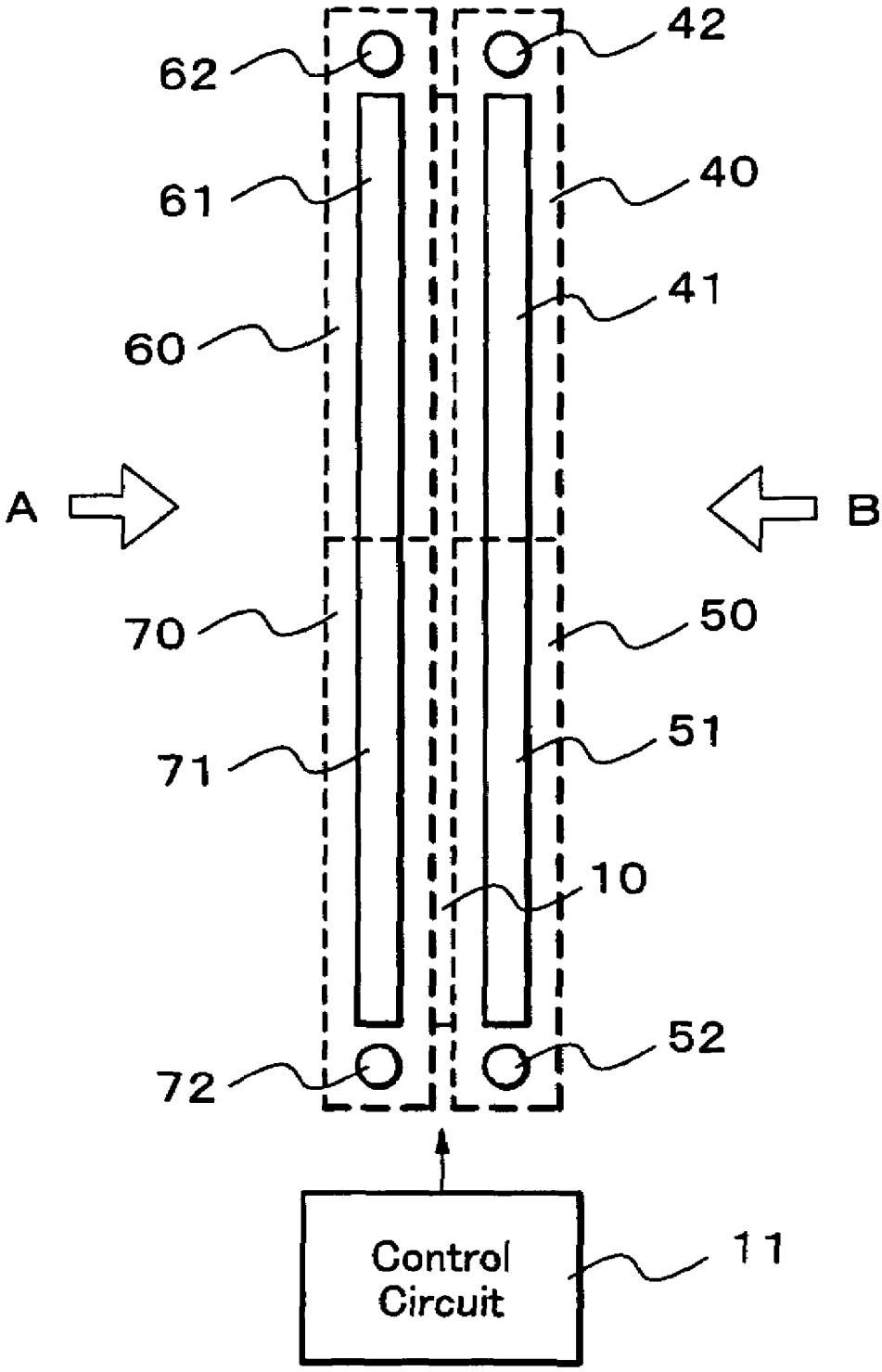
FIG. 4 is a block diagram for explaining a liquid crystal display device according to a second exemplary embodiment of the present invention.
Figure 5:
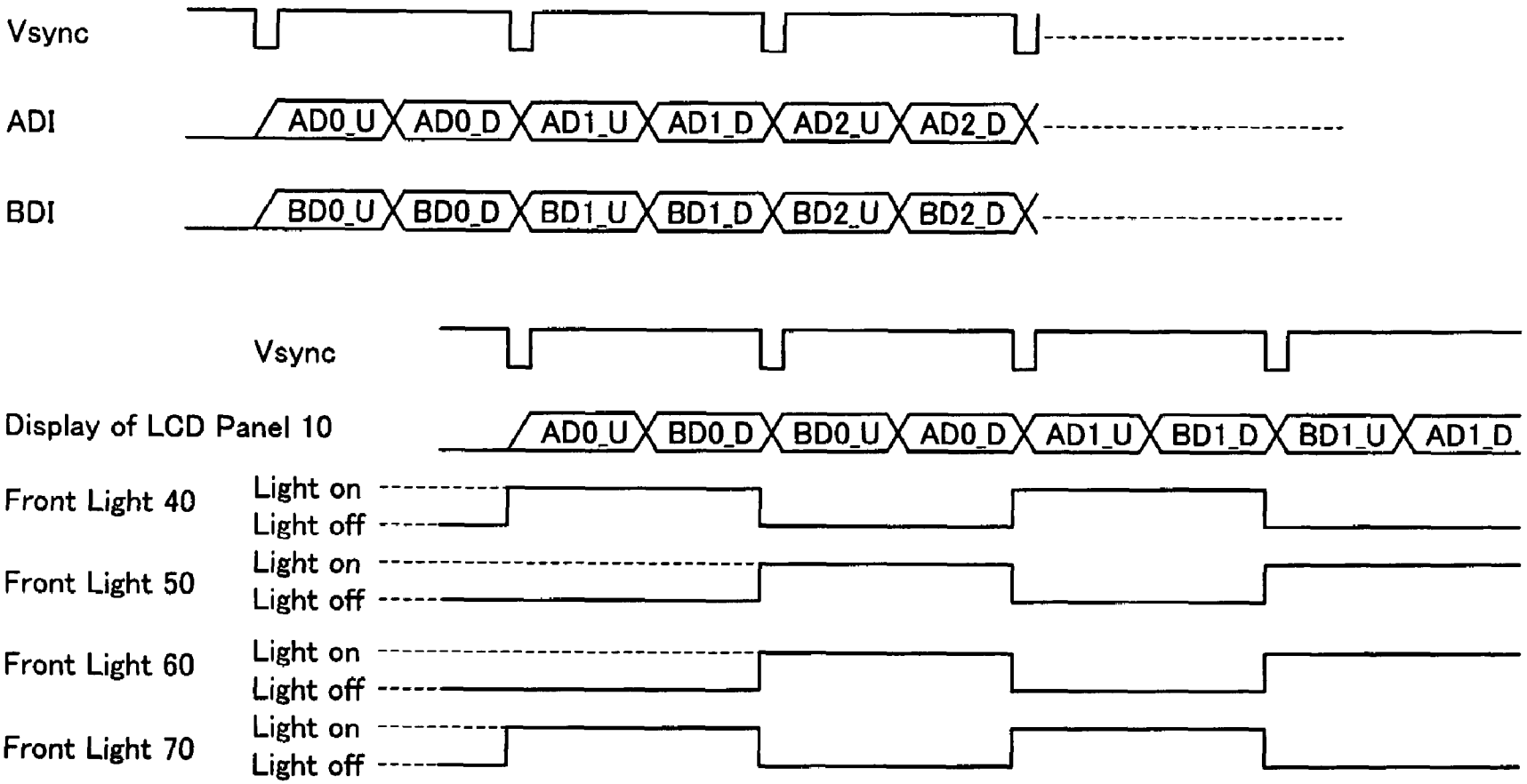
FIG. 5 is a wave form chart for explaining the operation timing of the driving control signal in FIG. 4.
Figure 6:
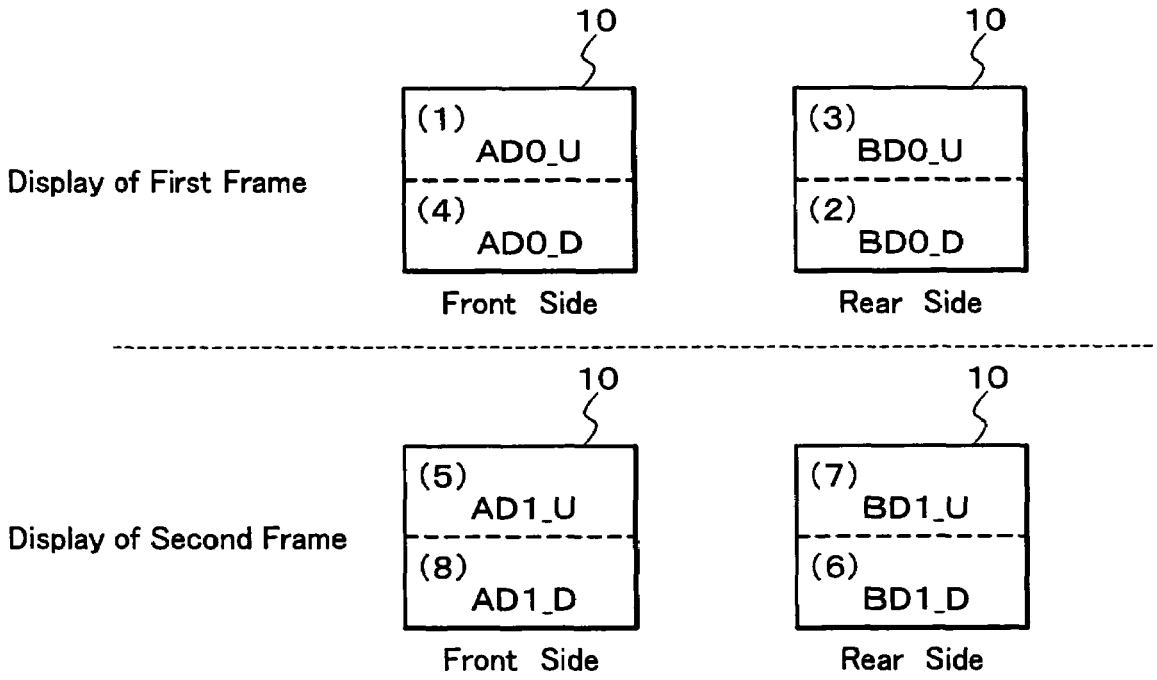
FIG. 6 is a pattern diagram for explaining the display action by the liquid crystal display device of the second embodiment.

With reference to FIGS. 4 to 6, the liquid crystal display device and the driving method of the second exemplary embodiment of a present invention are explained.

As shown in FIG. 4, the liquid crystal display device of the embodiment divides hypothetically the display area of a single liquid crystal panel 10 into an upper half and a lower half, and indications of front side, which can be seen from observation point A, and rear side, which can be seen from observation point B, are switched to every half-frame (½ frame) This liquid crystal display device includes a liquid crystal panel 10, lighting units 40, 50, 60, and 70 as an example of the illuminating means arranged at the both sides of the liquid crystal panel 10, and a control circuit 11 for carrying out drive control of the liquid crystal panel 10. Lighting units 40 and 60 irradiate light to the upper half of the display area of liquid crystal panel 10, and the lighting units 50 and 70 irradiate light to the lower half of the display area of liquid crystal panel 10. The lighting units 40, 50, 60, and 70 includes light guide plates 41, 51, 61, and 71 for irradiating light to the liquid crystal panel 10, and fluorescent lamps 42, 52, 62, and 72 as an example of the light source, respectively. Control circuit 11 inputs the image data signal for the directions of observation point A, and the image data signal for the directions of observation point B into the liquid crystal panel 10 alternately. When the upper half of the display area of the liquid crystal panel 10 gives the indication based on the image data signal for the directions of observation point A and the lower half of the display area gives the indication based on the image data signal for the directions of observation point B synchronous with the image data input action, the lighting units 50 and 60 are turned off, and the lighting units 40 and 70 are turned on. When the upper half of the display area of the liquid crystal panel 10 displays the image data signal for the directions of observation point B and the lower half of the display area of the liquid crystal panel 10 display the image data signal for the directions of observation point A, the lighting units 40 and 70 are turned off, and the lighting units 50 and 60 are turned on. By repeating such a display action alternately, when it sees simultaneously from both directions of observation points A and B, contents which are different each other, in all the display areas of the liquid crystal panel 10 can be displayed.

That is, the lighting units 40 and 50 are illuminating units for the indication for the direction of observation point A, respectively, and as mentioned above, they include the light guide plates 41 and 51 and the fluorescent lamps 42 and 52, respectively. Similarly, the lighting units 60 and 70 are illuminating units for the indication for the direction of observation point B, respectively, and as mentioned above, they include the light guide plates 61 and 71 and the fluorescent lamps 62 and 72, respectively. Therefore, the liquid crystal panel 10 can perform frame switching action based on the predetermined time set up in the control circuit 11, and can display a different image (it became independent) alternately.

Since the same circuitry as the control circuit 11 of the liquid crystal display device of the first exemplary embodiment mentioned above can be used for the control circuit 11 in the embodiment, it omits the explanation about each block configuration thereof. Technical terms shown in FIG. 2 are quoted for the explanation of operation. Since four lighting units 40, 50, 60, and 70 are used in the embodiment, the driver 33 of the control circuit 11 is organized so that these may be controlled.

As shown in FIG. 5, the embodiment has switched the front indication of a liquid crystal panel, and the rear indication of the liquid crystal panel in a half-frame period.

Control of an image data signal and the control timing of a lighting unit are explained below. First, the driver 33 in the control circuit 11 mentioned above takes in vertical synchronizing signal Vsync, and image data ADI and BDI. This image data ADI is an image data signal for giving the indication for observation point A of the liquid crystal panel 10. AD0_D denotes the line data in the lower half of image data of the first frame, and AD0_U denotes the line data in the upper half of image data of the first frame. Therefore, it becomes image data for one frame by the line data AD0_U and the line data AD0_D. Similarly, AD1_U and AD1_D denote the image data of the second frame, and AD2_U and AD2_D denote the image data of the third frame, respectively.

On the other hand, image data BDI is an image data signal for giving the indication for observation point B of the liquid crystal panel 10. BD0_U denotes the line data in the upper half of image data of the first frame, and BD0_D denotes the line data in the lower half of image data of the first frame. Therefore, it becomes image data for one frame by the line data BD0_U and the line data BD0_D. Similarly, BD1_U and the BD1_D denote the image data of the second frame, and BD2_U and BD2_D denote the image data of the third frame, respectively.

The driver 33 of the control circuit 11 mentioned above carries out drive controlling of the liquid crystal panel 10 so that the indication of even frame may be combination AD*_U and BD*_D, and the indication of odd frame may be combination BD*_U and AD*_D, about image data ADI for observation point A and image data BDI for observation point B.

When the driver 33 makes the liquid crystal panel 10 display image data AD*_U and BD*_D of even frames, the fluorescent lamp 42 of the lighting unit 40 and the fluorescent lamp 72 of the lighting unit 70 are turned on, and the fluorescent lamp 52 of the lighting unit 50 and the fluorescent lamp 62 of the lighting unit 60 are turned off. When the driver 33 makes the liquid crystal panel 10 display image data BD*_U and AD*_D of odd frame, the fluorescent lamp 42 of the lighting unit 40 and the fluorescent lamp 72 of the lighting unit 70 are turned off, and the fluorescent lamp 52 of the lighting unit 50 and the fluorescent lamp 62 of the lighting unit 60 are turned on.

As shown in FIG. 6, this display operation describes the indication of the first frame and the indication of the second frame which are displayed on liquid crystal panel 10. Numbers (1)-(8) given to each screen denotes the order of the indication.

According to the embodiment, it is since the front indication and the rear indication of the liquid crystal panel are switched with ½ frame periods, even when it sees simultaneously from the both sides of the panel, a different image can be displayed and useful information service can be obtained.

According to the control sequence, when the liquid crystal panel 10 is seen from observation point A during the even frame period, the fluorescent lamp 42 of the lighting unit 40 and the fluorescent lamp 72 of the lighting unit 70 are turned on, and the fluorescent lamp 52 of the lighting unit 50 and the fluorescent lamp 62 of the lighting unit 60 are turned off. At this time, in response to the light from lit fluorescent lamp 42, the emitted light of the lighting unit 40 can transmit the upper half of the display area of the liquid crystal panel 10, and the user can recognize visually the indication based on image data AD*_U of odd frame, supplied to the liquid crystal panel 10, from observation point A. When the liquid crystal panel 10 is seen from observation point A at this time, the lower half of the display area of the liquid crystal panel 10 serves as a black indication. When the liquid crystal panel 10 is seen from observation point B in the even frame period, the fluorescent lamp 42 of the lighting unit 40 and the fluorescent lamp 72 of the lighting unit 70 are turned off, and the fluorescent lamp 52 of the lighting unit 50 and the fluorescent lamp 62 of the lighting unit 60 are turned on. At this time, in response to the light from lit fluorescent lamp 72, the emitted light of the lighting unit 70 can transmit the lower half of the display area of the liquid crystal panel 10, and the user at the point B can recognize visually the indication based on image data BD*_D of the odd frame. When the liquid crystal panel 10 is seen from observation point B at this time, the upper half of the display area of the liquid crystal panel 10 serves as a black indication.

When the liquid crystal panel 10 is seen from observation point A during the odd frame period, the fluorescent lamp 62 of the lighting unit 60 and the fluorescent lamp 52 of the lighting unit 50 are turned on, and the fluorescent lamp 42 of the lighting unit 40 and the fluorescent lamp 72 of the lighting unit 70 are turned off. At this time, in response to the light from lit fluorescent lamp 52, the emitted light of the lighting unit 50 can transmit the lower half of the display area of the liquid crystal panel 10, and the user at the point A can recognize visually the indication based on image data AD*_D of the odd frame. When the liquid crystal panel 10 is seen from observation point A at this time, the upper half of the display area of the liquid crystal panel 10 serves as a black indication. When the liquid crystal panel 10 is seen from observation point B during this odd frame period, the fluorescent lamp 42 of the lighting unit 40 and the fluorescent lamp 72 of the lighting unit 70 are turned off, and the fluorescent lamp 62 of the lighting unit 60 and the fluorescent lamp 52 of the lighting unit 50 are turned on. At this time, in response to the light from lit fluorescent lamp 62, the emitted light of the lighting unit 60 can transmit the upper half of the display area of the liquid crystal panel 10, and the user at the point B can recognize visually the indication based on image data BD*_U of the odd frame. When the liquid crystal panel 10 is seen from observation point B at this time, the lower half of the display area of the liquid crystal panel 10 serves as a black indication.

Display operation is performed while switching this even frame period and an odd frame period with the cycle of the degree which cannot be recognized visually to one's eyes, in observation point A, image data AD*_U in the upper half of the display area of the liquid crystal panel 10 and image data AD*_D in the lower half of the display area of the liquid crystal panel 10 are combined, and thereby user recognize visually as one image by the whole display area of the liquid crystal panel 10. At this time, in observation point B, image data BD*_U in the upper half of the display area of the liquid crystal panel 10 and image data BD*_D in the lower half of the display area of the liquid crystal panel 10 are combined, and thereby user recognize visually as one image by the whole display area of the liquid crystal panel 10.

Referring to FIG. 6, for example, in the case of image data shown in FIG. 5, image data AD0_U in the upper half of the display area of the liquid crystal panel 10 and image data AD0_D in the lower half of the display area of the liquid crystal panel 10 are combined during the first frame, and recognized visually at the front side of the liquid crystal display device. At the rear side of the liquid crystal display device, during the first frame, image data BD0_U in the upper half of the display area of the liquid crystal panel 10 and image data BD0_D in the lower half of the display area of the liquid crystal panel 10 are combined, and recognized visually. At the front side of a liquid crystal display device, during the second frame, image data AD1_U in the upper half of the display area of the liquid crystal panel 10 and image data AD1_D in the lower half of the display area of the liquid crystal panel 10 are combined, and recognized visually. At the rear side of a liquid crystal display device, during the second frame, image data BD1_U in the upper half of the display area of the liquid crystal panel 10 and image data BD1_D in the lower half of the display area of the liquid crystal panel 10 are combined, and recognized visually. As shown in FIG. 5, the driver 33 supplies image data AD0_U, BD0_D, BD0_U, AD0_D, AD1_U, BD1_D, BD1_U, and AD1_D to the liquid crystal panel 10 in order. Thereby, the liquid crystal panel 10 displays in order of (1) to (8), as shown in FIG. 6.

For example, in case that the time of one frame is 1/60 seconds, operating frequency is 60 Hz. An even frame period and an odd frame period is 1/120 seconds, respectively. When switching lighting on and off of lighting units 40 to 70 in 1/120 seconds and switching the image data supplied to the liquid crystal panel 10, the black indication, made of the upper half or lower half of a display area as unit, is not recognized by one's eyes. That is, in observation point A, image data AD*_U in the upper half of the display area of the liquid crystal panel 10, and image data AD*_D in the lower half of the display area of the liquid crystal panel 10 are combined, and recognized visually as one image by the whole display area of the liquid crystal panel 10. In observation point B, image data BD*_U in the upper half of the display area of the liquid crystal panel 10, and image data BD*_D in the lower half of the display area of the liquid crystal panel 10 are combined, and recognized visually as one image by the whole display area of the liquid crystal panel 10.

According to the embodiment, since the front indication of a liquid crystal panel and the rear indication are switched with ½ frame periods. Even when it sees simultaneously from the both sides of the panel, different images can be displayed and thus various information can be obtained. Since the double-sided display using all the display areas of the front of a liquid crystal panel and all the display areas of the rear of a liquid crystal panel is realized dividing the display area of a liquid crystal panel, the area of a display area can be doubled compared with the case of a single-sided display.

Although the second embodiment is described that the whole display area of the liquid crystal panel 10 is recognized visually as one image, the display operation may be done by supplying image data for the upper half and the lower half of display area of the liquid crystal panel 10, which is independent to each other. A double-sided display can be performed only in the upper half of the liquid crystal panel 10, or a double-sided display can also be performed only in the lower half of the liquid crystal panel 10. This can be realized by changing the image data which the driver 33 supplies to the liquid crystal panel 10, without changing circuitry. Thus, according to the present invention, the double-sided indication is simultaneously realized, choosing the spatial relationship of a front indication and a rear indication freely. Therefore, the flexibility of the display area of the double-sided indication can be improved.

The preferred embodiments of the invention have been described. The fluorescent lamps 22 and 32 of the light source are formed in the upper side of the liquid crystal panel 10 in the first exemplary embodiment. It may be arranged in any position of the lower side, the right-hand side, left-hand side, right-and-left sides, or top-and-bottom sides. Although the fluorescent lamps 42, 52, 62, and 72 of the light source are arranged at both upper and lower sides of the liquid crystal panel 10 in the second exemplary embodiment, the lamps may be arranged at both right and left sides of the liquid crystal panel 10.

In the present invention, display devices, such as not only fluorescent lamps but also light emitting diodes (LEDs) and laser diodes (LDs), and electro-luminescence devices (ELs), can also be used as the light source. When light emitting diode (LED) is used, monochrome, for example, White light diode can also be used. Moreover, red light emitting diodes, green light emitting diodes, and blue light emitting diodes can be arranged. Construction may be used that emitting lights form these light emitting diodes are mixed in a light guide plate to generate white light.

Although preferred embodiments of the invention has been described with reference to the drawings, it will be obvious to those skilled in the art that various changes or modifications may be made without departing from the true scope of the invention.

What is claimed is:

1. A liquid crystal display device comprising:

a liquid crystal panel performing picture display according to input visual data, said liquid crystal panel having a front side that displays a front image and a rear side that displays a rear image;

a first lighting unit having a first light guide plate and a first light source supplying a light with the first light guide plate, and located in the front side of the liquid crystal panel;

a second lighting unit having a second light guide plate and a second light source supplying a light with the second light guide plate, and located in the rear side of the liquid crystal panel; and a control unit for turning on the second light source of the second lighting unit and radiating the liquid crystal panel, and supplying a first picture data to the liquid crystal panel, during a first display period, and turning on the first light source of the first lighting unit and radiating the liquid crystal panel, and supplying a second picture data to the liquid crystal panel, during a second display period different from the first display period, such that two different images can selectively be formed simultaneously on the front side and on the rear side because of the different timing.

2. The liquid crystal display device according to claim 1, wherein the first lighting unit and the second lighting unit are flat-shaped lighting units, respectively.

3. The liquid crystal display device according to claim 1, wherein the liquid crystal panel is transmissive type, and wherein picture display is performed by a light transmitted through the liquid crystal panel, which is radiated from the first lighting unit or the second lighting unit.

4. The liquid crystal display device according to claim 1, wherein one frame period comprises the first display period and the second display period.

5. The liquid crystal display device according to claim 1, wherein the first lighting unit and the second lighting unit are controlled to turn on or off the light by a time-divisional mode, respectively.

6. The liquid crystal display device according to claim 1, further comprising:

a third lighting unit having a third light guide plate and a third light source supplying a light with the third light guide plate, and located in front side of the liquid crystal panel; and a fourth lighting unit having a fourth light guide plate and a fourth light source supplying a light with the fourth light guide plate, and located in the rear side of the liquid crystal panel;

wherein the control unit turns on the third light source of the third lighting unit for radiating the liquid crystal panel, and supplies a third picture data to the liquid crystal panel, during the first display period, and wherein the control unit turns on the fourth light source of the fourth lighting unit for radiating the liquid crystal panel, and supplies a fourth picture data to the liquid crystal panel, during the second display period.

7. The liquid crystal display device according to claim 6, wherein said first, second, third and fourth lighting units are flat-shaped lighting units, respectively.

8. The liquid crystal display device according to claim 6, wherein picture display is performed by a light transmitted through the liquid crystal panel, which is radiated from the third lighting unit or the fourth lighting unit.

9. The liquid crystal display device according to claim 6, wherein the third lighting unit and the fourth lighting unit are controlled to turn on or off the light by a time-divisional mode, respectively.

10. A method of driving a liquid crystal display device, the liquid crystal display device comprising a liquid crystal panel performing a picture display according to input visual data; a first lighting unit having a first light guide plate and a first light source supplying a light with the first light guide plate, and located in front side of the liquid crystal panel; and a second lighting unit having a second light guide plate and a second light source supplying a light with the second light guide plate, and located in the rear side of the liquid crystal panel, said liquid crystal panel having a front side that displays a front image and a rear side that displays a rear image, the driving method comprising:

turning on the second light source of the second lighting unit and radiating the liquid crystal panel, and supplying a first picture data to the liquid crystal panel, thereby providing said rear image during a first display period, and turning on the first light source of the first lighting unit and radiating the liquid crystal panel, and supplying a second picture data to the liquid crystal panel, thereby providing said front image during a second display period different from the first display period, wherein said first display period being different from said second display period permits two different images to be displayed simultaneously on said front side and said rear side.

11. The driving method of the liquid crystal display device according to claim 10, wherein the first lighting unit and the second lighting unit are flat-shaped lighting units, respectively.

12. The driving method of a liquid crystal display device according to claim 10, wherein the liquid crystal panel is transmissive type, and wherein picture display is performed by a light transmitted through the liquid crystal panel, which is radiated from the first lighting unit or the second lighting unit.

13. The driving method of the liquid crystal display device according to claim 10, wherein one frame period comprises the first display period and the second display period.

14. The driving method of a liquid crystal display device according to claim 10, wherein the first lighting unit and the second lighting unit are controlled to turn on or off the light by a time-divisional mode, respectively.

15. The driving method of the liquid crystal display device according to claim 10, the liquid crystal display device further comprising:

a third lighting unit having a third light guide plate and a third light source supplying a light with the third light guide plate, and located in front side of the liquid crystal panel; and a fourth lighting unit having a fourth light guide plate and a fourth light source supplying a light with the fourth light guide plate, and located in the rear side of the liquid crystal panel;

the driving method further comprising:

turning on the third light source of the third lighting unit and radiating the liquid crystal panel, and supplying a third picture data to the liquid crystal panel, during the first display period, and turning on the fourth light source of the fourth lighting unit and radiating the liquid crystal panel, and supplying a fourth picture data to the liquid crystal panel, during the second display period.

16. The driving method of the liquid crystal display device according to claim 15, wherein said first, second, third and fourth lighting unit are flat-shaped lighting units, respectively.

17. The driving method of the liquid crystal display device according to claim 15, wherein picture display is performed by a light transmitted through the liquid crystal panel, which is radiated from the third lighting unit or the fourth lighting unit.

18. The driving method of the liquid crystal display device according to claim 15, wherein the third lighting unit and the fourth lighting unit are controlled to turn on or off the light by a time-divisional mode, respectively.

19. The driving method of the liquid crystal display device according to claim 15, wherein the first display period is an even frame period, and wherein the second display period is an odd frame period.

* * * * *